US011240595B2

(12) United States Patent
Barney et al.

(10) Patent No.: US 11,240,595 B2
(45) Date of Patent: Feb. 1, 2022

(54) CASTELLATED COSMETIC MESH STIFFENER FOR ACOUSTIC FLOW NOISE REDUCTION

(71) Applicant: Apple Inc., Cupertino, CA (US)

(72) Inventors: Jaden A. Barney, Charlotte, NC (US); Benjamin M. Russo, San Jose, CA (US); Brandon R. Collins-Smoot, Campbell, CA (US); Douglas G. Fournier, San Jose, CA (US); Hongsheng Lin, Singapore (SG); Jared P. Ostdiek, Santa Clara, CA (US); Jason B. Neevel, Santa Clara, CA (US); Joseph F. Maldonado, Rohnert Park, CA (US); Justin D. Crosby, Cupertino, CA (US); Michael A. Fisher, Middletown, DE (US); Per K. Larsson, Los Altos, CA (US); Teemu P. Sipila, Campbell, CA (US); Ville R. Riikonen, San Jose, CA (US); Hengxin Ni, Shanghai (CN); Tiffany Hu, Campbell, CA (US)

(73) Assignee: Apple Inc., Cupertino, CA (US)

( * ) Notice: Subject to any disclaimer, the term of this patent is extended or adjusted under 35 U.S.C. 154(b) by 100 days.

(21) Appl. No.: 16/785,294

(22) Filed: Feb. 7, 2020

(65) Prior Publication Data

US 2021/0076127 A1 Mar. 11, 2021

Related U.S. Application Data

(60) Provisional application No. 62/897,728, filed on Sep. 9, 2019.

(51) Int. Cl.
*H04R 1/28* (2006.01)
*H04R 1/02* (2006.01)

(52) U.S. Cl.
CPC ..... *H04R 1/288* (2013.01); *H04R 1/023* (2013.01); *H04R 1/025* (2013.01); *H04R 2499/11* (2013.01)

(58) Field of Classification Search
CPC ..... H04R 1/288; H04R 1/023; H04R 1/025; H04R 2499/11
See application file for complete search history.

(56) References Cited

U.S. PATENT DOCUMENTS

| | | | |
|---|---|---|---|
| 10,015,574 | B1 | 7/2018 | Luce et al. |
| 2016/0073183 | A1 | 3/2016 | Auclair et al. |
| 2016/0073194 | A1 | 3/2016 | Auclair et al. |
| 2017/0070795 | A1 | 3/2017 | Meyer et al. |
| 2017/0070813 | A1 | 3/2017 | Wah et al. |

*Primary Examiner* — Regina N Holder
(74) *Attorney, Agent, or Firm* — Dorsey & Whitney LLP

(57) ABSTRACT

An electronic device can include a housing defining a first aperture and at least partially defining an internal volume. An air permeable component can be disposed at the first aperture and the device can include a support component defining a second aperture within the first aperture and engaging the air permeable component. The support component can include a sidewall disposed in the first aperture and defining at least one notch.

20 Claims, 12 Drawing Sheets

CASTELLATED COSMETIC MESH STIFFENER FOR ACOUSTIC FLOW NOISE REDUCTION

CROSS-REFERENCE TO RELATED APPLICATION(S)

This application claims priority to U.S. Provisional Patent Application No. 62/897,728, filed 9 Sep. 2019, titled "CASTELLATED COSMETIC MESH STIFFENER FOR ACOUSTIC FLOW NOISE REDUCTION," the entire disclosure of which is hereby incorporated by reference.

FIELD

The described embodiments relate generally to electronic device components. More particularly, the present embodiments relate to acoustic electronic device components.

BACKGROUND

Currently there are a wide variety of electronic devices that have apertures defined by their housings to allow acoustic components (such as microphones and speakers) located within an internal volume defined by the housing of the electronic device to acoustically communicate with the outside environment. To protect both the acoustic component and any other components within the internal volume of the electronic device from damage, for example, due to the ingress of debris through the aperture, acoustically or air permeable materials can be employed at, within, or proximate to the apertures.

These acoustically permeable materials and the components used to secure and position them can, however, increase the distortion and noise associated with acoustic signals transmitted through the aperture. Accordingly, electronic devices can incorporate components, features, and methods of manufacturing acoustic components to achieve desired levels of performance, protection, and aesthetics.

SUMMARY

According to some examples of the present disclosure, an electronic device can include a housing defining a first aperture and at least partially defining an internal volume, an air permeable component disposed at the first aperture, and a support component defining a second aperture within the first aperture and engaging the air permeable component, the support component including a sidewall disposed in the first aperture and defining at least one notch.

In some examples, the sidewall can define an open flux area in communication with the second aperture that is at least 10% larger than an area of the first aperture. The electronic device can further include a speaker disposed in the internal volume, wherein an acoustic signal played by the speaker and transmitted through the first aperture and the second aperture has low measurable higher order harmonic distortion and acoustic flow noise. The sidewall can define at least six notches. The sidewall can surround a periphery of the second aperture. The air permeable component can include an acoustic mesh. The support component can include steel. At least a portion of the air permeable component can be disposed between the support component and a portion of the housing defining the aperture. The support component can include a base extending perpendicularly from the sidewall, and the base can be adhered to an interior surface defined by the housing.

According to some examples, a support component for an air permeable component can include a base defining an aperture, and a sidewall extending from the base adjacent to the aperture, the sidewall including two or more protruding members. The sidewall defining an open flux area in communication with the aperture can be at least 10% larger than an area of the aperture.

In some examples, the sidewall can include a first portion extending from the base adjacent to a first peripheral portion of the aperture, a first set of protruding members extending from the first portion in a same direction as the first portion, a second portion extending from the base adjacent to a second peripheral portion of the aperture, the second peripheral portion opposite the first peripheral portion, and a second set of protruding members extending from the second portion in a same direction as the second portion. The first set of protruding members can include two protruding members and the second set of protruding members can include two protruding members. The open flux area can be at least 15% larger than the area of the aperture. The protruding members can have a rectangular shape. The protruding members can have a triangular or rounded shape. The protruding members can define a top surface of the support component that is slanted or nonparallel relative to the base.

According to some examples, a method of forming a support component for an air permeable component can include drawing a material into a shape defining a recess, forming multiple apertures in a portion of the material defining the recess, drawing the material to increase a depth of the recess, and forming the material into a structure defining an aperture, the structure including one or more protrusions adjacent to the aperture.

In some examples, the one or more protrusions can include a castellated sidewall defining an open flux area at least 10% larger than the aperture and in communication with the aperture. The structure can include a base and a sidewall extending therefrom, the one or more protrusions extending from the sidewall and having a top surface that is slanted or nonparallel relative to the base. Forming multiple apertures can include forming three apertures in the portion of the material defining the recess.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
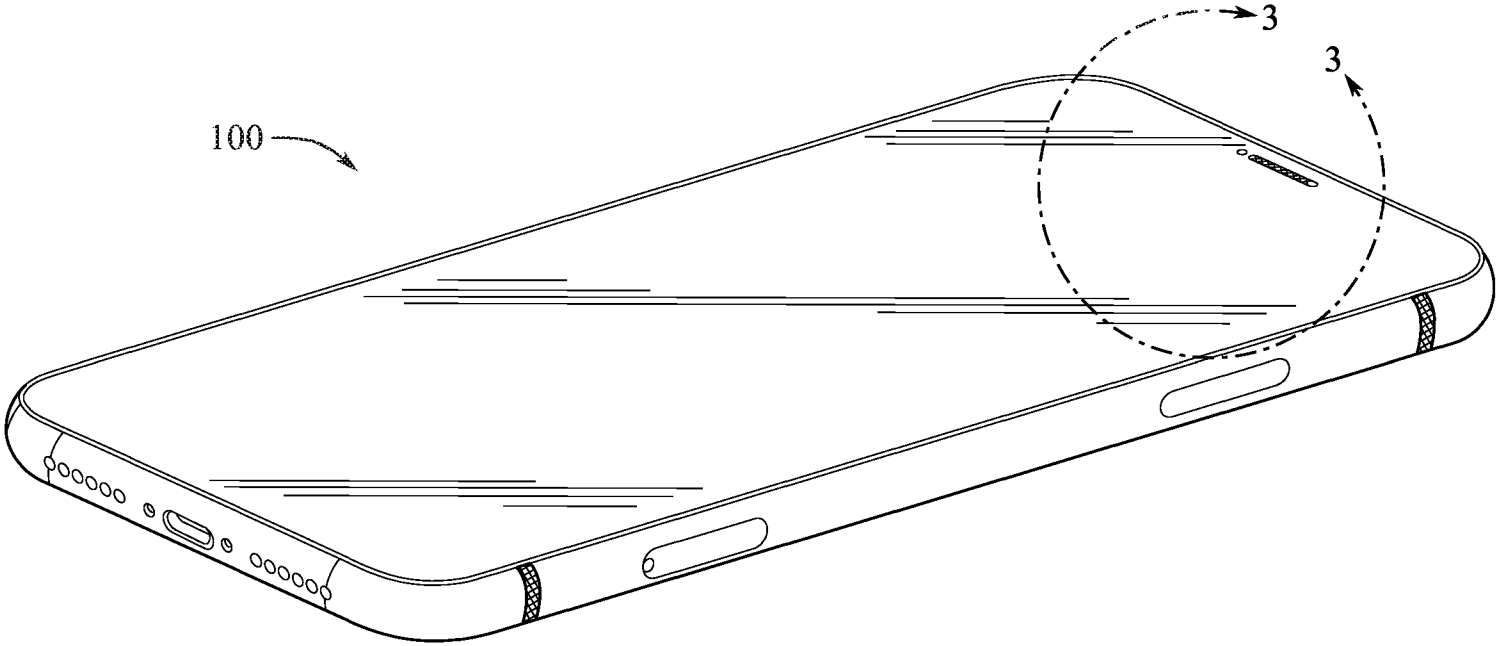
FIG. 1 shows a perspective view of an electronic device.

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments, as defined by the appended claims.

There is an increasing drive for electronic devices to become smaller and thinner. This desire for devices having reduced volumes can impact the performance of certain components of device that can typically require a large volume to achieve desired levels of performance. For example, in the context of acoustic components such as speakers, sound quality and speaker performance can be increased by increasing the size of the speaker and/or the hole or aperture through which the speaker transmits acoustic signals. Accordingly, as acoustic components such as speakers and the associated apertures of the device become smaller, other ways to improve or achieve desired levels of performance can be desired.

While a large unobstructed aperture for a speaker can produce the best sound quality, such an aperture can leave the internal volume of the device, and the components in communication with the aperture, susceptible to physical damage from debris or other undesired objects impacting or entering into the device through the aperture. In some examples, a protective component can be positioned at the aperture to prevent ingress of debris or other objects. This protective component, however, must still allow the transmission of acoustic energy and/or air through the aperture without undesirably degrading the quality of the acoustic signal or drastically reducing airflow. Accordingly, in some examples, the protective component can be an air permeable component, such as an acoustic mesh, as described herein.

In some examples, a sufficiently air permeable component, such as a mesh, can benefit from additional structural or physical support to provide a desired level of protection. That is, in some examples, the air permeable component can be supported by a support component that not only retains the air permeable component at desired positions, but can also provide physical or mechanical support to the air permeable component.

As described herein, acoustic signals generated by a speaker can be transmitted through an aperture defined by the housing of an electronic device. In some examples, this aperture can be smaller than is ideal to transmit an extremely high quality and clean sound. Forcing air, such as with a speaker, through this reduced aperture can increase the velocity of air flow, causing flow noise, distortion, and reduction in sound pressure. This reduced sound pressure can be compensated for when generating the acoustic signal. The shape of the aperture, and the structures contained therein, such as the support component, can further reduce the open area of the aperture, and can also undesirably alter the quality of an acoustic signal passing therethrough. The altered acoustic signal and the reduced aperture area can further increase air velocity, generating additional flow noise and distortion of the acoustic signal.

Accordingly, the presence of a support component can demand the use of a larger aperture or acoustic component, such as a speaker, to achieve a similar sound quality as compared to an aperture that does not include the support component. Accordingly, it can be desirable to increase the open flux area of the support component, that is, the open area of the support component that does not obstruct the aperture, so as to reduce the levels of signal distortion and flow noise associated with the support component while allowing the flow of audio waves. As the support components described herein can allow for higher quality audio signals, the electronic devices including these components can produce higher quality sound with the same components, or can use smaller components to produce a similar quality of sound while providing additional space in the internal volume of the device for other components and/or features.

According to some examples, an electronic device can include a housing and a transparent cover overlying a display assembly. The housing and the cover can define an internal volume, and the cover can define a housing aperture in communication with the internal volume. An air-moving component, such as a speaker, can be disposed in the internal volume, for example, below the housing aperture. The device can further include an air permeable component, such as an acoustic mesh disposed at the housing aperture, and a support component further defining a second aperture located within the housing aperture and engaging the air permeable component. The support component can include a base portion defining the second aperture and a sidewall disposed in the housing aperture defined by the cover. The sidewall can define at least one notch and can further define an open flux area in communication with and larger than the first aperture.

These and other examples are discussed below with reference to FIGS. 1-12. However, those skilled in the art will readily appreciate that the detailed description given herein with respect to these Figures is for explanatory purposes only and should not be construed as limiting.

FIG. 1 illustrates a perspective view of an example of an electronic device 100. The electronic device 100 shown in FIG. 1 is a mobile wireless communication device, such as a smartphone. The smartphone of FIG. 1 is merely one representative example of a device that can be used in conjunction with the systems and methods disclosed herein. Electronic device 100 can correspond to any form of a wearable electronic device, a portable media player, a media storage device, a portable digital assistant ("PDA"), a tablet computer, a computer, a mobile communication device, a GPS unit, a remote-control device, or any other electronic device. The electronic device 100 can be referred to as an electronic device, or a consumer device.

Figure 2:
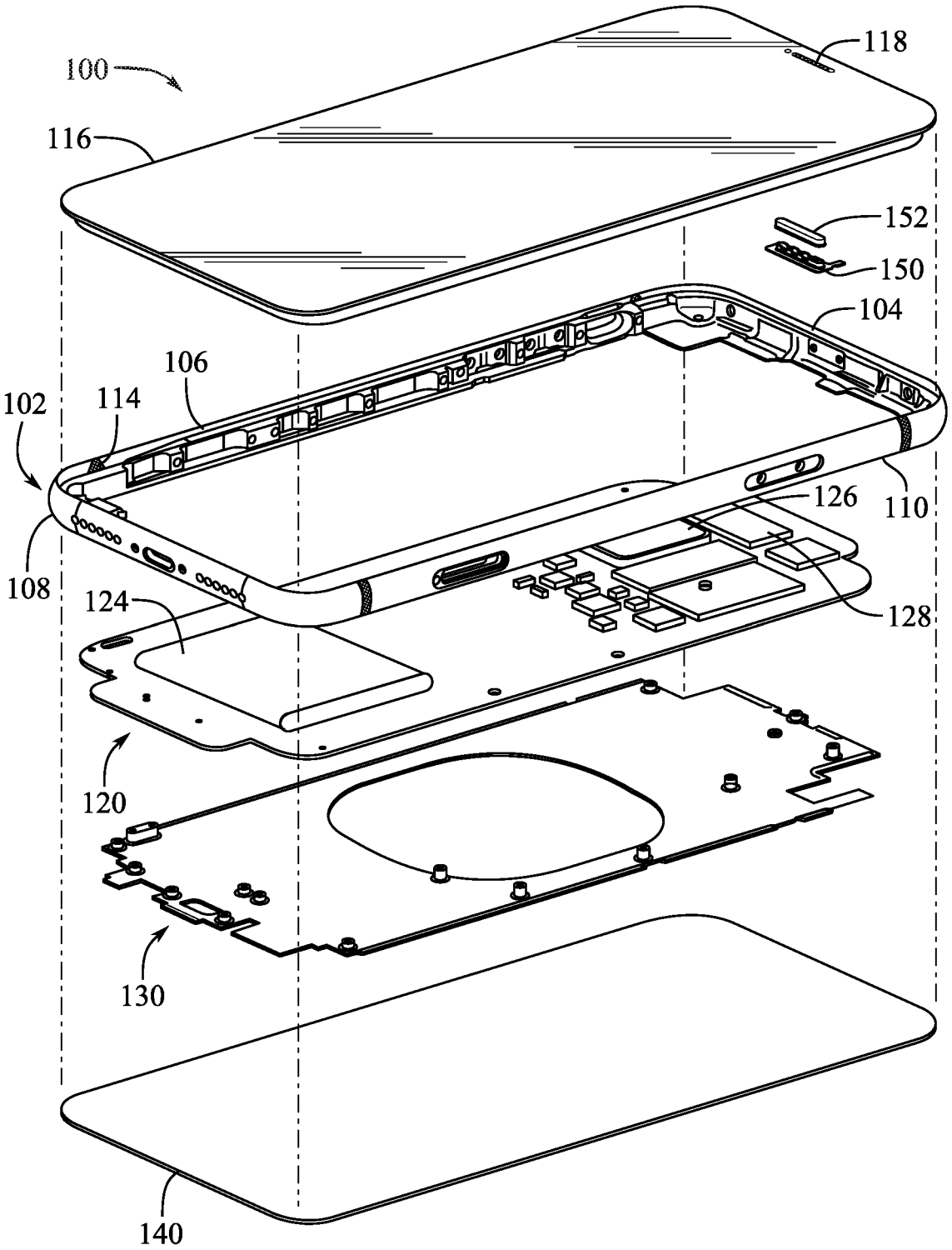
FIG. 2 shows an exploded view of the electronic device of FIG. 1.

FIG. 2 illustrates an exploded view of the electronic device 100. The electronic device 100 can have a housing that includes a frame or a band 102 that defines an outer perimeter and a portion of the exterior surface of the electronic device 100. The band 102, or portions thereof, can be joined to one or more other components of the device as described herein. In some examples, the band 102 can include several sidewall components, such as a first sidewall component 104, a second sidewall component 106, a third sidewall component 108 (opposite the first sidewall component 104), and a fourth sidewall component 110. The sidewall components can be joined, for example, at multiple locations, to one or more other components of the device, as described herein. The housing of the device 100, for example, the band 102, can include one or more features to receive or couple to other components of the device 100.

In some examples, some of the sidewall components can form part of an antenna assembly (not shown in FIG. 2). As a result, a non-metal material or materials can separate the sidewall components of the band 102 from each other, in order to electrically isolate the sidewall components. For example, a separating material 114 separates the second sidewall component 106 from the third sidewall component 108. The aforementioned materials can include an electrically inert or insulating material(s), such as plastics and/or resin, as non-limiting examples. Further, as described herein, one or more of the sidewall components can be electrically connected to internal components of the electronic device, such as a support plate, as described herein. In some examples, these electrical connections can be achieved by joining a sidewall component to an internal component, for example, as part of the antenna assembly.

The electronic device 100 can further include a display assembly that can include a protective cover 116. The display assembly can include multiple layers, with each layer providing a unique function. In some examples, the outer layer, cover, or portion 116 of the display assembly defining an external surface of the device 100 can be considered part of the housing of the device. Further, the protective cover 116 of the display assembly can include any desired transparent material or combination of materials, such as polymeric material, or ceramic material such as sapphire or glass. In some examples, the display assembly, such as the protective cover 116, can define an aperture 118 that can communicate with the internal volume defined by the housing and the display assembly. Furthermore, a rear protective cover 140 can be connected to the sidewall components and can further define the external surface of the device 100. The rear protective cover 140 can be made of any sufficiently structural materials, including metal, glass, or combinations thereof, and can define any number of apertures.

The device 100 can include internal components, such as a system in package (SiP) 126, including one or more integrated circuits such as a processors, sensors, and memory. The device 100 can also include a battery 124 housed in the internal volume of the device 100. Additional components, such as a haptic engine, can also be included in the device 100. In some examples, the display assembly can be received by and/or be attached to the band 102 by one or more attachment features. In some examples, one or more of these internal components can be mounted to a circuit board 120. The electronic device 100 can further include a support plate 130, also referred to as a back plate or chassis, that can provide structural support for the electronic device 100. The support plate 130 can include a rigid material, such as a metal or metals. Such components can be disposed within an internal volume defined, at least partially, by the band 102, and can be affixed to the band 102, via internal surfaces, attachment features, threaded connectors, studs, posts, and/or other fixing features, that are formed into, defined by, or otherwise part of the band 102. In some examples, an attachment feature can be formed by an additive process and/or a subtractive process, such as machining.

The electronic device 100 can also include acoustic components disposed in the internal volume. For example, the electronic device 100 can include an air moving component 128 and a microphone (not shown). In some examples, the air moving component 128 can be a speaker that can move air in and out of the aperture 118 of the cover glass 116. Consequently, in some examples, the speaker 128 can transmit acoustic signals and/or energy through the aperture 118.

The electronic device 100 can also include an acoustically permeable or air permeable component 152 disposed at the aperture 118 of the cover 116. The air permeable component 152 can extend across the entire area of the aperture 118. In some examples, the air permeable component can be disposed at least partially in the aperture 118. In some examples, the air permeable component 152 can be disposed outside of the aperture 118, for example, above or below the aperture 118. The air permeable component 152 can include any form of acoustically or air permeable material or materials. In some examples, the air permeable component 152 can include a mesh, a membrane, or another structure including holes, perforations, or passageways that can allow the transmission of air and acoustic energy through the air permeable component 152.

In some examples, the air permeable component 152 can be an acoustic mesh and can include multiple woven wires. In some examples, the air permeable component can include metal, polymer, ceramic, or combinations thereof. For example, the air permeable component 152 can include steel and can be formed from multiple woven steel wires. In some examples, the air permeable component 152 can include one or more sheets of material including multiple perforations formed therein. For example, the air permeable component 152 can include a polymer sheet including multiple perforations.

The device 100 can also include a support component 150 that can hold or support the air permeable component 152. For example, the support component 150 can physically hold and support the air permeable component 152 so that it is held substantially planar and disposed in line with the exterior surface of the cover 116. The support component 150 can aid the air permeable component 152 in retaining its shape when subjected to external forces. For example, the electronic device 100 can be placed in a pocket or a purse along with a set of keys or other hard objects. The keys can be incidentally pressed against the air permeable component 152, and can exert pressure on the air permeable component 152 that might otherwise cause it to deform, if not supported by the support component 150. In some examples, the support component 150 can provide the air permeable component 152 with increased resilience to plastic deformation by reinforcing some or all of the air permeable component 152, for example, at portions around the perimeter of the aperture 118. As a result, support component 150 can enable the air permeable component 152 to sustain high levels of force and stress without resulting in plastic deformation.

Together, the air permeable component 152 and the support component 150 can be considered an acoustic cover assembly. The acoustic cover assembly, including the air permeable component 152 and the support component 150, can be disposed over any number of air moving components of the electronic device 100, such as speaker 128. In some examples, the air permeable component 152 and the support component 150 can serve to provide a physical barrier and a protection at the aperture 118 to prevent or reduce the ingress of debris and/or impacts from external objects. The air permeable component 152 can also provide a desired aesthetic appearance at the aperture 118, and can prevent components disposed in the internal volume of the device 100 from being visible to a user through the aperture 118

Figure 3:
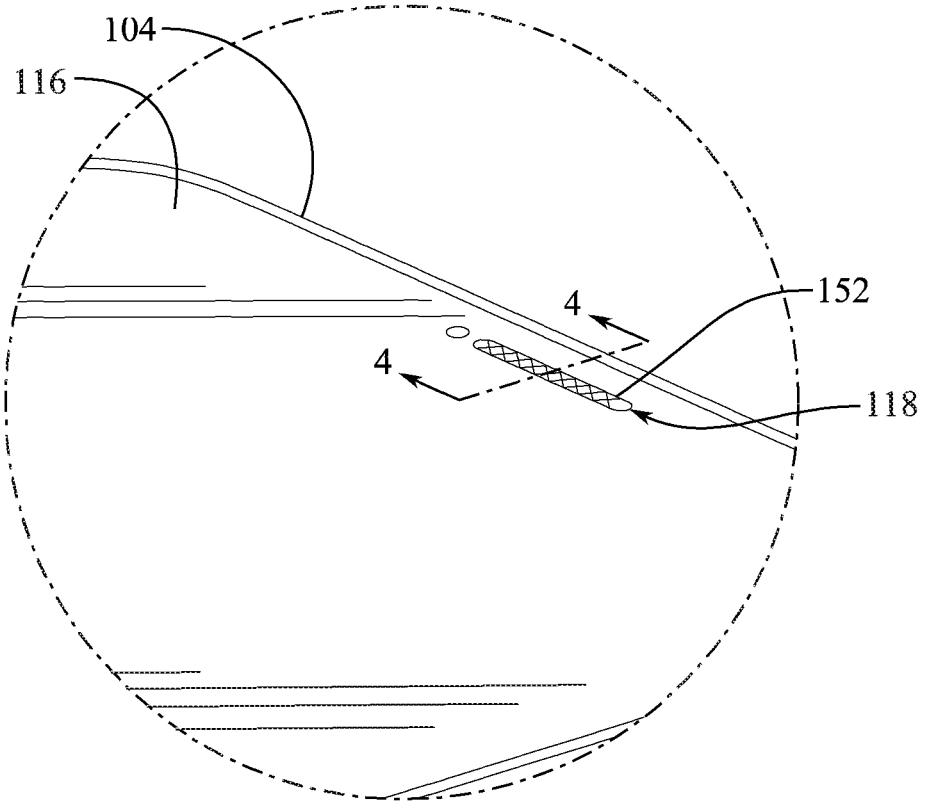
FIG. 3 shows a close-up view of a portion of the electronic device of FIG. 1
Figure 4:
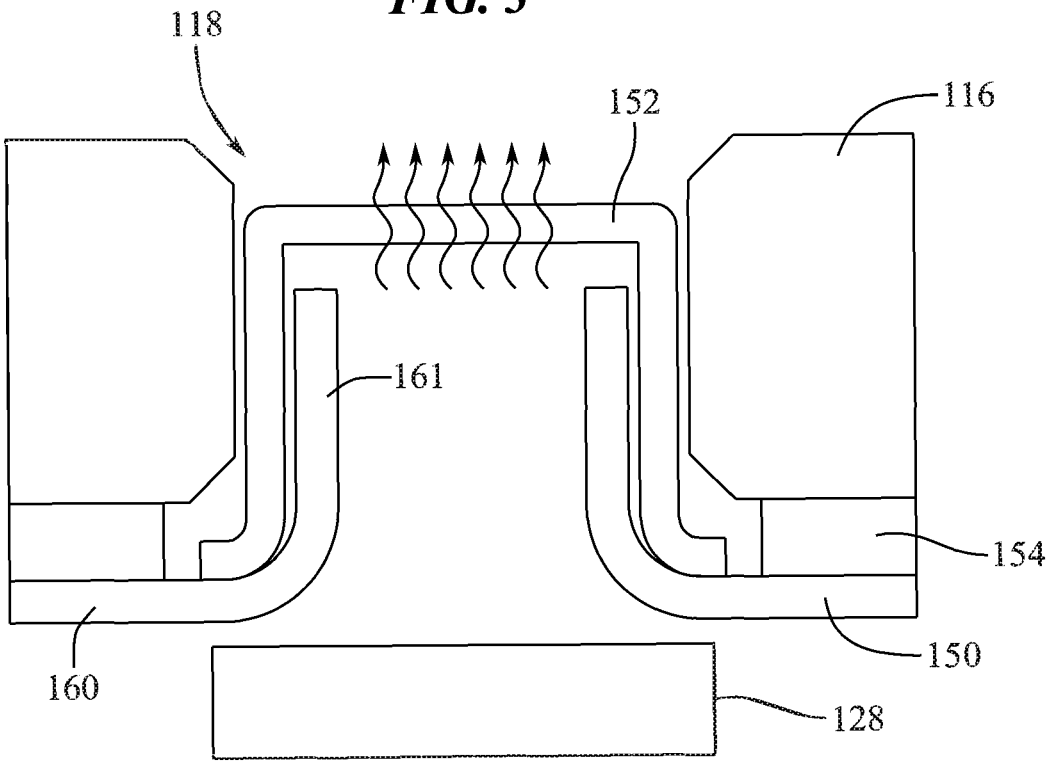
FIG. 4 shows a cross-sectional view of the portion of the electronic device of FIG. 3.

FIG. 3 shows a close-up view a portion of the electronic device 100 including the cover 116 secured to a sidewall component 104 of the band 102. FIG. 3 also shows the aperture 118 defined by the cover 116 and the air permeable component 152 disposed at the aperture 118 and extending across substantially an entire area of the aperture 118. FIG. 4 shows a cross-sectional view of the portion of the electronic device 100 shown in FIG. 3.

As described herein, the cover 116 of the device 100 can define an aperture 118. In some examples, at least some of the air permeable component 152 can be disposed in the aperture 118. In some examples, a top surface or exterior surface defined by the air permeable component 152 can extend across or cover substantially the entire area of the aperture 118. In some examples, the exterior or topmost surface of the air permeable component 152 can be recessed or disposed below the exterior surface of the cover 116, for example, the surface defined by the portion of the cover 116 surrounding the aperture 118. In some examples, however, the exterior or topmost surface of the air permeable component 152 can be substantially level or flush with the exterior surface of the cover 116, or in some examples, can even be proud or protrude from the surface of the cover 116.

As described herein, the air permeable component 152 can allow air to pass through the aperture 118 (indicated with reference arrows) while preventing debris or external objects from entering the internal volume of the device through the aperture 118 and potentially damaging components therein, such as the speaker 128. The support component 150 can be disposed below the air permeable component 152 and can be engaged therewith. Further, at least some of the support component 150 can extend into the aperture 118. In this particular example, the support component can include a base portion 160 and a sidewall portion 161 extending from the base 160 into the aperture 118. The sidewall portion 161 of the support component 150 can provide physical support to the air permeable component 152 while the base 160 of the support component 150 can be secured to the housing of the device 100, for example, an interior surface of the cover 116. In some examples, the support component 150 can be secured to the housing by adhering, gluing, joining, bonding, or combinations thereof. For example, the base 160 of the support component 150 can be bonded to an interior surface of the cover 116 by a pressure sensitive adhesive or heat activated film 154.

In some examples, at least a portion of the air permeable component 152 can be disposed between the sidewall 161 of the support component 150 and a surface of the cover 116 defining the aperture 118. In these examples, the sidewall portion 161 can exert a force or pressure on the air permeable component 152 to thereby press a portion of the air permeable component 152 against the cover 116. In some examples, this configuration can provide mechanical support to the air permeable component 152 and can aid in retaining the air permeable component 152 in a desired position. Further, the air permeable component 152 can be engaged with the base 160 and can be secured, affixed, joined, bonded, glued, or adhered thereto. In some examples, a portion of the air permeable component 152 can be welded to the support component 150, for example, to the base 160. Further details of the air permeable component 152 and the support component 150 are described below with reference to FIG. 5

Figure 5:
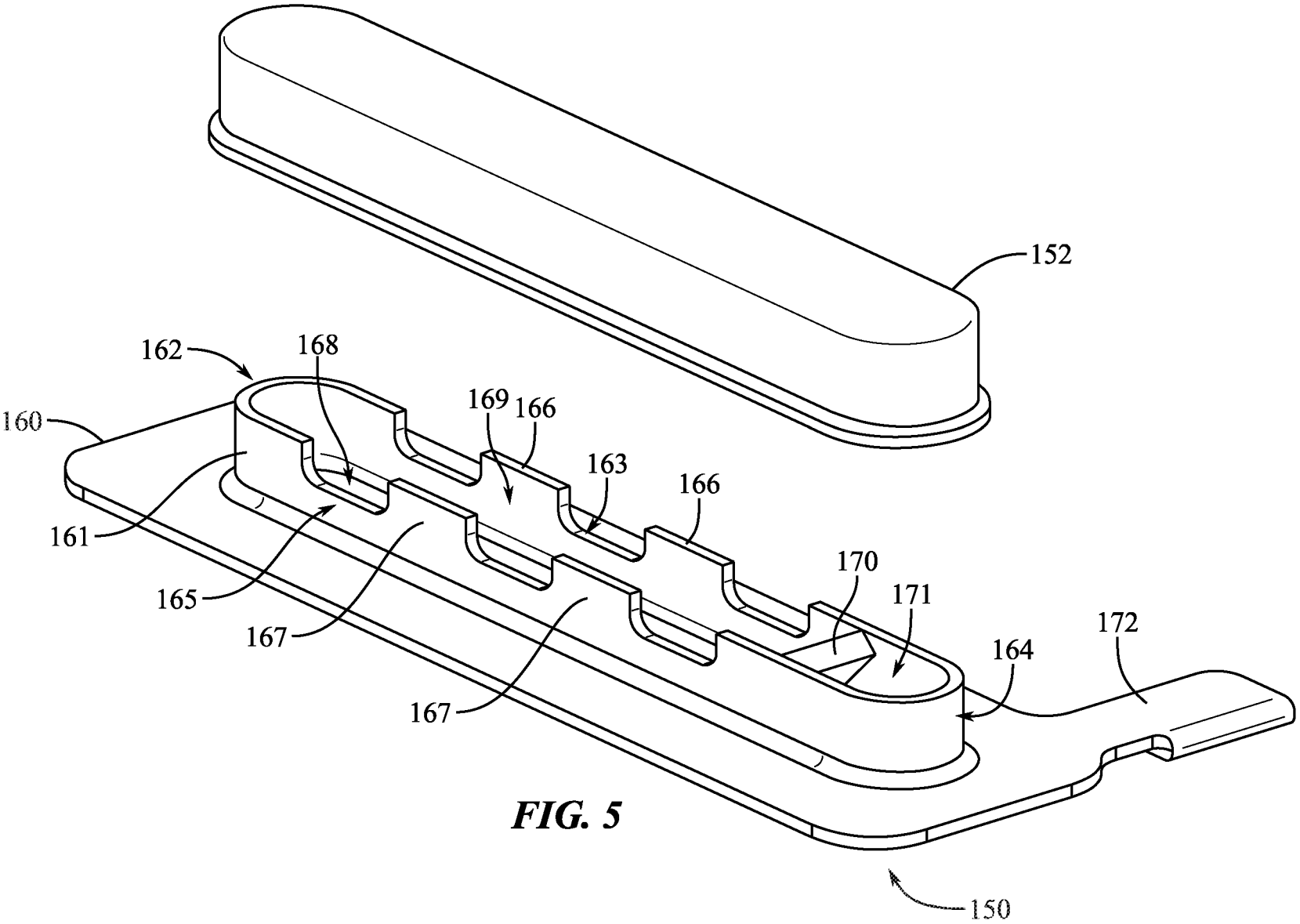
FIG. 5 shows a perspective view of acoustic components of an electronic device.

FIG. 5 shows a perspective view of the air permeable component 152 and the support component 150 separate from one another. As described herein, the support component 150 can include a base portion 160 and a sidewall portion 161 extending from the base portion 160. In some examples, the sidewall 161 can extend perpendicularly from the base portion 160. In other examples, the sidewall 161 can extend at any angle or variety of angles from the base portion 160 and can extend at the same or similar angle as the angle of the walls of the cover 116 defining the aperture 118. The base 160 can define an opening or aperture 168. In some examples, this aperture 168 can have a size and peripheral shape the same as, similar to, or corresponding to the size and shape of the aperture 118.

In some examples, the sidewall 161 can extend from the base 160 at a location or locations substantially adjacent to the periphery of the aperture 168. In some examples, the sidewall 161 can include any number of portions having various heights or profiles, and defining any number of features described herein. For example, sidewall 161 can include a first end portion 162 and a second end portion 164 that can be disposed at opposite ends of the aperture 168. In some examples, the sidewall 161 can include a first portion 163 that can extend from the base 160 adjacent to a portion of the aperture 168. In some examples, one or more protrusions or protruding members 166 can further extend from the first portion 163. In some examples, the protruding members 166 can extend from the first portion 163 in the same direction that the first portion 163 extends from the base 160. In this particular example, the first portion 163 can include two protruding members 166, although the first portion 163 can include any number of protruding members. In some examples, adjacent protruding members 166 and the first portion 163 can together define a notch or a gap in the sidewall 161. In some examples, a notch or a gap can be defined by the protruding members 166, the first portion 163, and an adjacent first end portion 162, as shown. In some examples, the sidewall 161 can define 6 notches. In some examples, the sidewall 161 can define any number of notches, such as 1, 2, 3, 4, 5, 6, 7, 8, 9, 10, 15, 20, or even more notches.

The sidewall 161 can further include a second portion 165 that can extend from the base 160 adjacent to the aperture 168, and can be disposed opposite the first portion 163. In some examples, the second portion 165 can be substantially similar to the first portion 163. For example, the second portion 165 can also include a number of protruding members 167 that extend from the second portion 165. The protruding members 167 of the second portion 165 can also at least partially define a number of notches or gaps. Accordingly, in some examples, the sidewall 161 can include a number of protruding members and/or portions 166, 167 that can define a number of notches or gaps, as shown. In some examples, these notches can be regularly spaced along the sidewall 161, although it will be appreciated that any number or configuration or size of notches or gaps can be defined by the sidewall 161.

As the sidewall 161 extends from the base 160 at locations adjacent to the aperture 168 defined by the base 160, the sidewall 161 can define an open flux area 169 that is in communication with the aperture 168. In some examples, and as described herein, the features of the sidewall 161, such as the protruding members 166, 167, can provide the sidewall 161 with a castellated structure. Further, the various notches and gaps defined by the features of the sidewall 161 can be part of the open flux area 169. The open flux area 169 can be larger than the area of the aperture 168 or aperture 118. Although the open flux area 169 can have a three dimensional shape, it can be conceptualized as the surface area of the air permeable component 152 that is in communication with the aperture 168 and that is not obstructed or occluded by the sidewall 161 when the air permeable component 152 is disposed over and engaged with the support component 150, for example, as shown in FIG. 4. The size of the open flux area 169 is measured in units of area, such as square millimeters or square inches.

In the present example, the open flux area 169 includes the area surrounded by the top surface of the sidewall 161. In other words, the open flux area 169 includes an area that is identical or substantially similar to the area of the aperture 168, as well as the open area of the notches defined by the first and second end portions 162, 164, the first and second portions 163, 165, and the protruding members 166, 167. Accordingly, the open flux area 169 can be at least 5% larger, at least 10% larger, at least 15% larger, at least 20% larger, or even larger than the area of the aperture 168 and/or the area of the aperture 118. In some examples the open flux area 169 can be about 17% larger than the area of the aperture 168 and/or the area of the aperture 118. As described herein, this larger open flux area 169 provided by the side wall 161 can result in a reduced level of flow noise for air or any other fluid passing through the aperture 168 and/or aperture 118, and can result in a reduced amount noise or distortion associated with an acoustic signal passing through the aperture 168 and aperture 118.

In some examples, the increased open flux area 169 of the support component 150 can decrease fluid flow for the same output sound pressure level, as compared to a support component that has a smaller open flux area, such as an open that is the same size or smaller than an aperture in which it is disposed, such as aperture 118. In some examples, an acoustic signal played by a speaker 128 of the device 100 and transmitted through the open flux area 169 can have a lower measurable higher order harmonic distortion (such as $12^{th}$ through $15^{th}$ order) and acoustic flow noise, as compared to an acoustic signal played by the speaker 128 and transmitted through a support component having an open flux area the same size as, or smaller than the aperture 118 and/or aperture 168. For example, the acoustic signal transmitted through the open flux area 169 can have a measurable higher order harmonic distortion and acoustic flow noise that is less than 90%, less than 75%, less than 50%, less than 25%, less than 10%, less than 5%, or even less than 1% or smaller of the measurable higher order harmonic distortion and acoustic flow noise of the same acoustic signal transmitted through a support component having an open flux area that is about the same size as, or smaller than the aperture 118 and/or aperture 168.

The support component 150 can also include a number of additional features. For example, the support component 150 can include a grounding member 172 that can extend from the base 160 and that can provide electrical grounding for the support component 150. In some examples, the support component 150 can include a baffle 170 disposed in the aperture 168 between portions of the sidewall 161. In some examples, the baffle 170, together with the second end portion 164, can at least partially separate or isolate a region 171 of the open flux area 169. In some examples, this region 171 can be disposed over an acoustic component such as a microphone, and the baffle 170 can serve to prevent acoustic signals passing through the aperture 168 and open flux area 169 from interfering with incoming acoustic signals that pass through the region 171 where they can be received by the microphone.

Any number or variety of electronic device components can include some or all of the structure of the support components described herein. In some examples, a support component or a component including some or all of the features of a support component described herein can provide physical or structural support for any number of additional components, for example, components disposed at, spanning, or otherwise adjacent or near to any aperture or opening of an electronic device. In some examples, components including the features described herein can be formed by any number or combination of additive and/or subtractive manufacturing processes or steps, such as drawing, forming, piercing, and punching. Various examples of support components and other acoustic components, as well as processes for forming the same, are described below with reference to FIGS. 6A-10B.

Figure 6A:
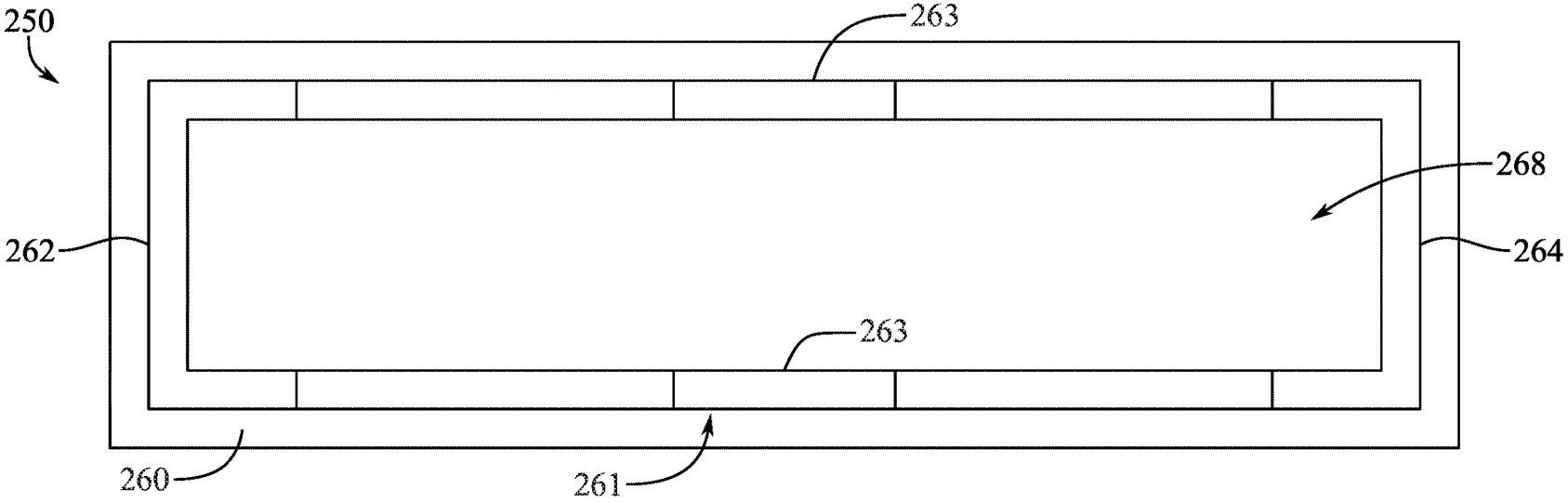
FIG. 6A shows a top view of an acoustic component.

FIG. 6A shows an example of a support component 250 that can be substantially similar to, and can include some or all of the features of the support components described herein, such as support component 150. In some examples, the support component 250 can include a base 260 that defines an aperture or opening 268. In some examples, the aperture 268 can have an elongated shape, for example, having a length that is longer than a width. In some examples, the aperture 268 can have any desired shape, and can be rectangular, ovoid, circular, triangular, combinations thereof, or even irregularly shaped.

In some examples, the support component 250 can further include a sidewall or sidewalls 261 extending from the base 260 at a location or locations adjacent to the periphery of the aperture 268. In some examples, the sidewall 261 can include a portion that extends from the base 260 and surrounds an entire periphery of the aperture 268. In some other examples, however, the sidewall 261 can include one or more portions that extend from the base 260 along one or more regions or sections of the periphery of the aperture 268. In some examples, the one or more regions or sections of the periphery of the aperture 268 can be at any variety of locations along the periphery of the aperture 268, and are not necessarily adjacent to one another. For example, as shown, the sidewall 261 can include a first end portion 262 that extends from the base 260 along a section of the periphery of the aperture 268, and a second end portion 264 that extends from the base 260 along a section of the periphery of the aperture 268 opposite the location of the first end portion 262.

In some examples, the sidewall 261 can further include one or more protruding members 263. In some examples, the protruding members 263 can extend from the base 260 or another portion of the sidewall 261 adjacent to the aperture 268, and at locations between the first end portion 262 and the second end portion 264. In some examples, the protruding members 263 can extend a same height from the base 260, and can further extend a same height as the first end portion 262 or the second end portion 264. Although illustrated as having a rectangular shape or profile, in some examples, the protruding members 263 can have any desired shape or profile, such as a rounded, triangular, or any other polygonal shape.

Figure 6B:
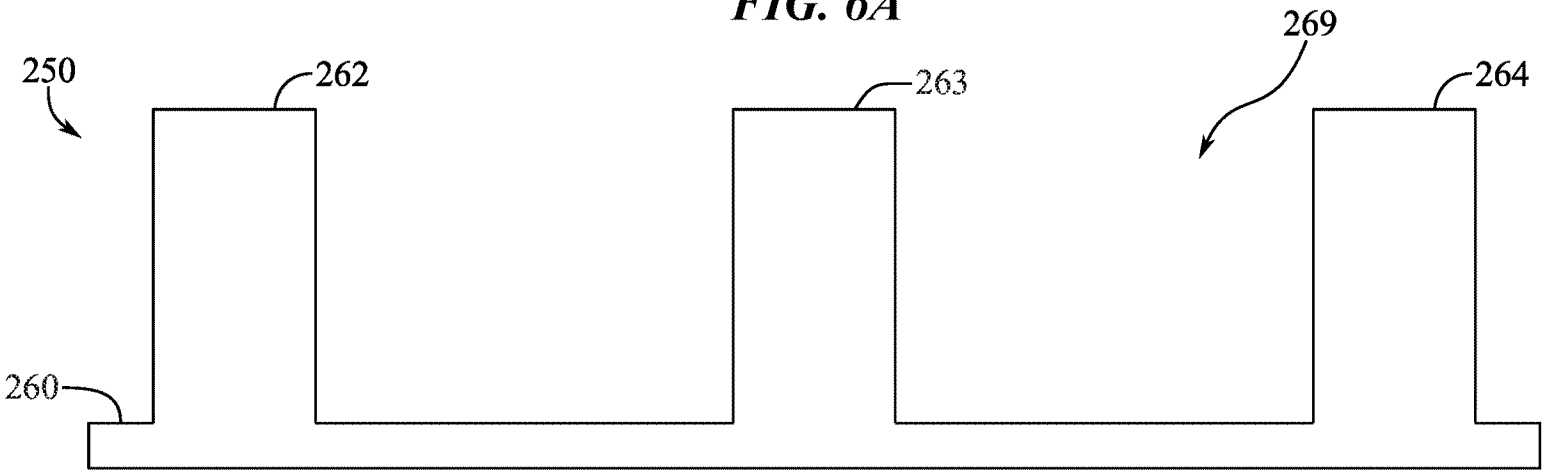
FIG. 6B shows a side view of the acoustic component of FIG. 6A.

FIG. 6B shows that the portions of the sidewall 261 can together define one or more notches or gaps in the sidewall 261. For example, as shown, the first end portion 262, the protruding members 263, and the base 260 can define two notches therebetween that can be disposed adjacent to the aperture 268. In some examples, the base 260 can define an aperture that includes indentations, notches, or gaps positioned at, and corresponding to, the locations of the notches defined by the sidewall 261. That is, in some examples, the aperture 268 can have a shape that includes a larger open area at locations where the sidewall 261 defines a gap, and these larger open areas can be in communication with the gap or gaps so as to provide an even larger open flux area as defined by the component 250.

Although the present example includes a sidewall 261 defining four equally sized and spaced notches, it will be appreciated that the support component 250 can include a sidewall 261 defining any number of notches having any variety of desired sizes or shapes. As described with respect to FIG. 5, the sidewall 261 including the portions defining one or more notches or gaps can define an open flux area 269 in communication with the aperture 268, such as a regularly shaped aperture 268 as shown, or an aperture including its own notches or gaps positioned to correspond to and be in communication with the notches of the sidewall 261. The open flux area 269 can be at least 5% larger, at least 10% larger, at least 15% or larger, at least 20% larger, or even larger than the area of the aperture 268. In some examples, the open flux area 269 can be about 17% larger than the area of the aperture 268. Further details of a support component for an air permeable or acoustically permeable component of an electronic device are detailed below with reference to FIGS. 7A-7B.

Figure 7A:
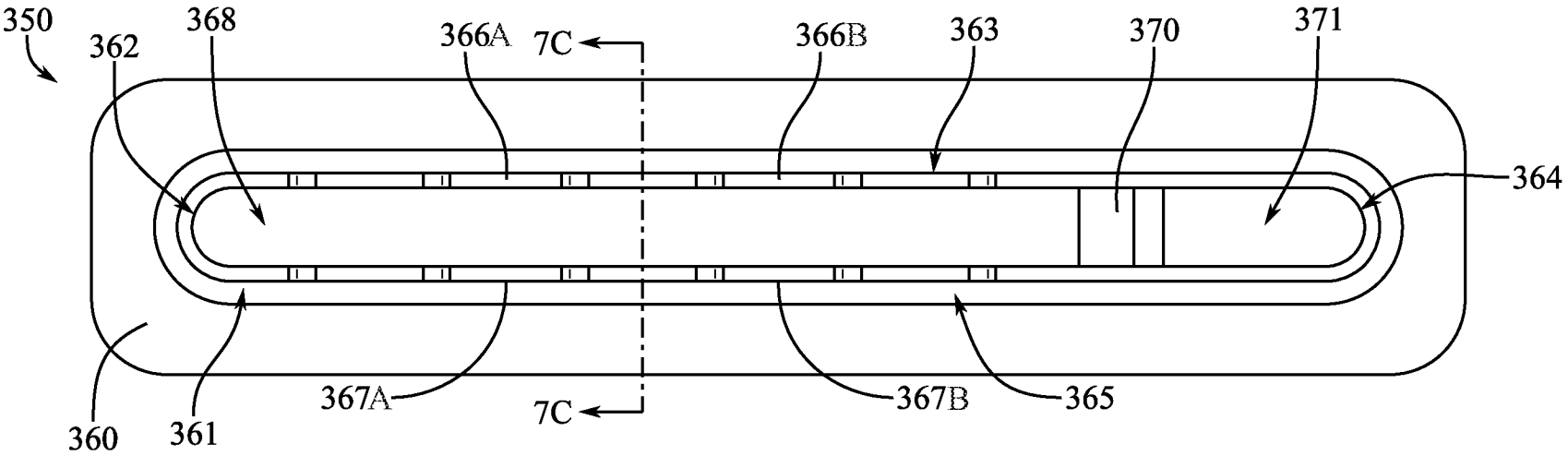
FIG. 7A shows a top view of an acoustic component.
Figure 7B:
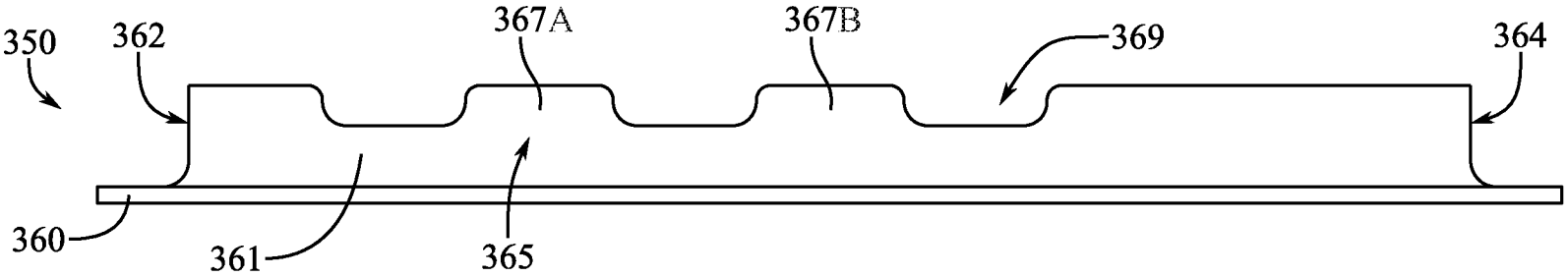
FIG. 7B shows a side view of the acoustic component of FIG. 7A.

FIG. 7A shows a top view, and FIG. 7B shows a corresponding side view of a support component 350 that can be substantially similar to, and can include some or all of the features of the support components described herein, such as support components 150, 250. As with the support components described previously, the support component 350 can include a base 360 that defines an aperture 368. In some examples, a sidewall 361 can extend from the base 360 along one or more sections or regions of the periphery of the aperture 368.

The sidewall 361 can include a first end portion 362, and a second portion 364, and these portions 362, 364 can be disposed opposite one another along one or more sides, sections, or edges of the aperture 368. In some examples, the first end portion 362 and the second end portion 364 can extend substantially an entire height of the sidewall 361, and can extend around two or more sides or sections of the periphery of the aperture 368 so as to have a curved or non-linear profile. The sidewall 361 can also include a first portion 363 extending from the base 360 along a section of the periphery of the aperture 368, and can include one or more protruding members 366A, 366B that can further extend from the first portion 363. A second portion 365 of the sidewall 361 can be disposed along a section of the periphery of the aperture 368 opposite the first portion 363 and can include one or protruding members 367A, 367B extending therefrom. The aperture 368 and/or an open flux area 369 defined by the sidewall 361 can be divided into one or more regions by a baffle element 370 that can be disposed in the aperture 368 and/or open flux area 369. The baffle element 370 can, along with portions of the sidewall 361, such as the second end portion 364, define a region 371 that can be disposed over an acoustic component such as a microphone, as described above with reference to FIG. 5.

The portions of the sidewall 361, such as first and second portions 363, 365, the protruding members 366A, 366B, 367A, 367B, and the first and second end portions 362, 364 can define a number of notches therebetween. In the present example, the protruding members 366A, 366B, 367A, 367B have a substantially rectangular shape including rounded or chamfered corners and transitions between other portions of the sidewall 361. Accordingly, the notches can have substantially rectangular profiles or shapes including rounded corners and edges corresponding to the shapes of the protruding members 366A, 366B, 367A, 367B, as shown. The sidewall 361 including those portions that define the notches can define an open flux area 369 that can be larger than the aperture 368. The larger area of the open flux area as compared to the aperture 368 can reduce a level of flow noise associated with air or acoustic signals passing through the aperture 368 and open flux area, as described herein.

Figure 7C:
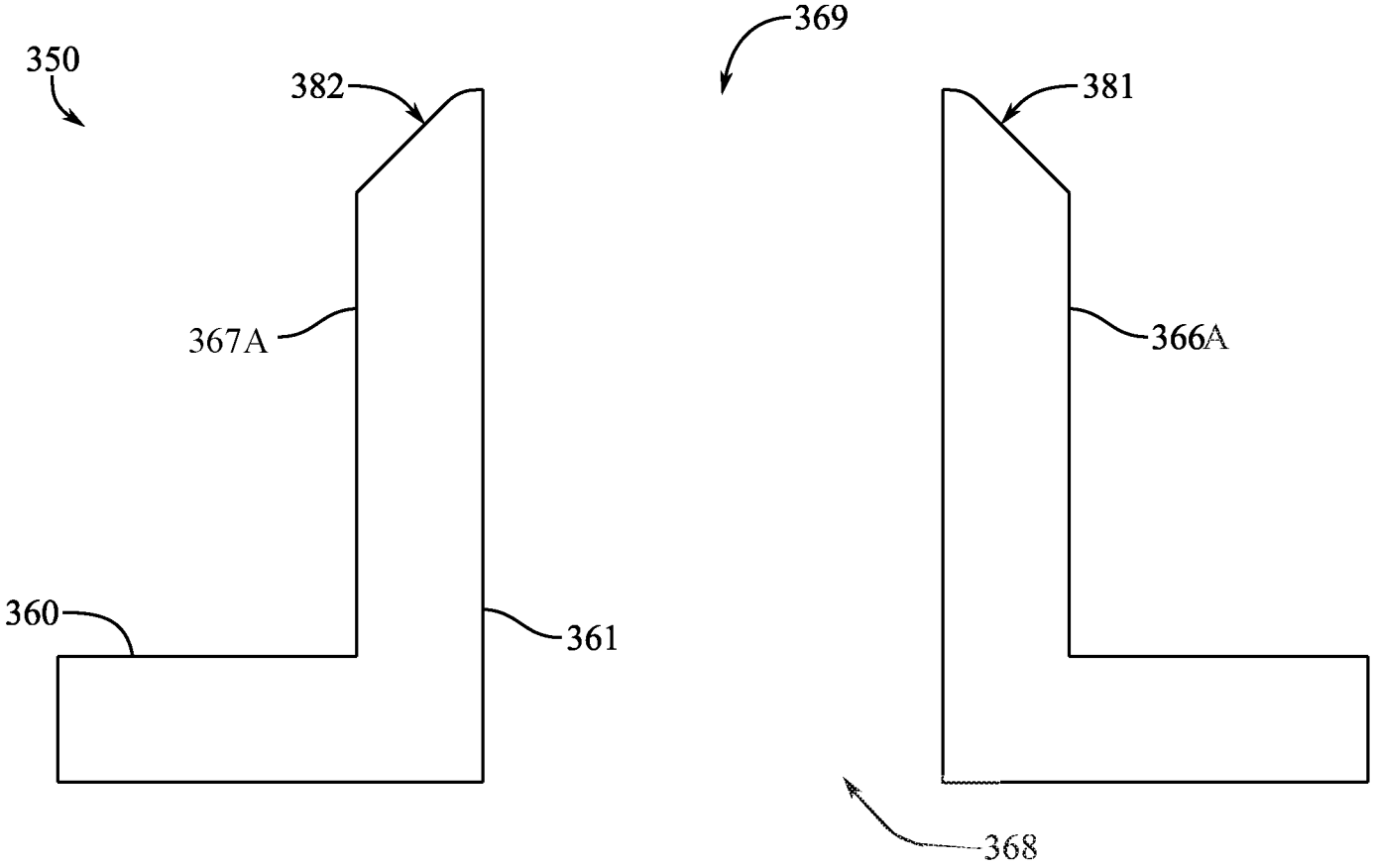
FIG. 7C shows a cross-sectional view of the acoustic component of FIG. 7A.

FIG. 7C illustrates a cross-sectional view of the support component 350, taken along line 7C in FIG. 7A. As can be seen, the sidewall 361 can extend perpendicularly from the base 360. In some examples, the sidewall 361 including the protruding members 366A, 367A can have a substantially similar depth or thickness as the base 360. In some examples, this can be because the base 360 and the sidewall 361 can be an integrally formed unitary body. In some examples, one or more portions of the sidewall 361 can define a top or support surface of the support component 350. This top or support surface can provide structural support to an air permeable component, as described herein. In some examples, the portion of the top surface 381 defined by the protruding member 366A can have a profile or shape that is not aligned with, or parallel to, the base 360. For example, as shown, the portion of the surface 381 can be angled, slanted, or nonparallel with respect to a surface of the base 360. In some examples, the portion of the surface 381 can slant downwardly or away from the open flux area 369. Similarly, the portion of the surface 382 defined by the protruding member 367A can be angled, slanted, or nonparallel relative to the base 360, or a surface thereof, and can angle or slant downwardly away from the open flux area 369 and away from the aperture 368. In some examples, the top surface, or portions of the top surface such as portions 381, 382, can have a non-planar profile or shape, such as a rounded or curved shape. Further details of an example of a support component 450 are described below with respect to FIGS. 8A-8B.

Figure 8A:
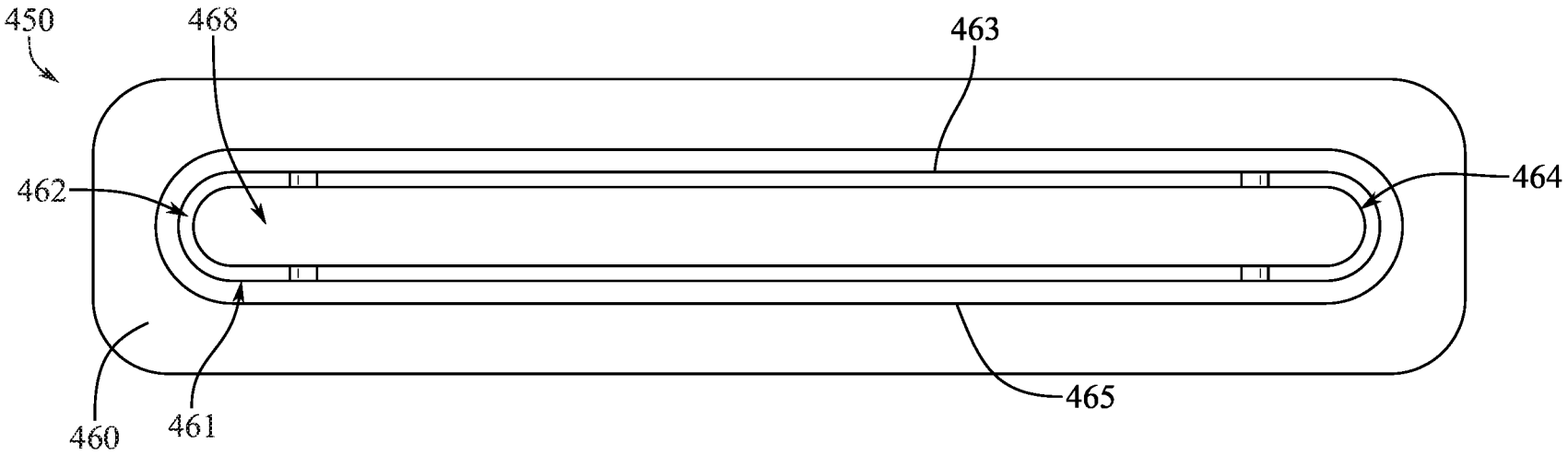
FIG. 8A shows a top view of an acoustic component.

FIG. 8A illustrates a top view of a support component 450 that can be substantially similar to, or can include some or all of the features of the support components described herein, such as support components 150, 250, 350. The support component 450 can include a base 460 defining an aperture 468 and a sidewall 461 extending from the base 460 along all or just a section or sections of the periphery of the aperture 468. In some examples, the base 460 and the sidewall 461 can be integrally formed and can include a single unitary body. In some examples, however, the sidewall 461 can include multiple portions, such as a first end portion 462 and a second end portion 464 that can be disposed opposite one another and adjacent to the aperture 468.

In some examples, the sidewall 461 can also include a first portion 463 and a second portion 465 that can extend between the first end portion 462 and the second end portion 464. In some examples, the first portion 463 and the second portion 465 can be disposed adjacent to the aperture 468, and opposite one another. Further, in some examples, the first portion 463 and/or second portion 465 do not extend an entire height of the sidewall 461. That is, in some examples, the first portion 463 and/or the second portion 465 do not extend from the base 460 a same height as the first end portion 462 and/or second end portion 464.

Figure 8B:
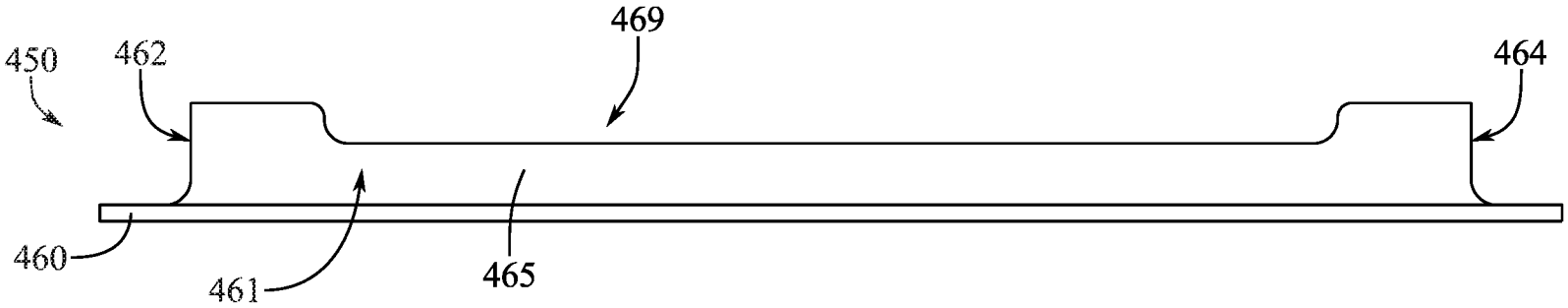
FIG. 8B shows a side view of the acoustic component of FIG. 8A.

In some examples, the first portion 463 and/or the second portion 465 do not include any protruding members. In some examples, the first and second end portions 462, 464 and the first and second portions 463, 465 can define one or more notches or gaps. As described herein, these notches can be part of an open flux area 469 defined by the sidewall 461 that is larger than, and is in communication with, the aperture 468. In some examples, the notch or notches defined by the sidewall 461 can have any desired dimensions, and as illustrated in FIG. 8B, can extend along an entire section or side of the periphery of the aperture 468. In some examples, the sidewall 461 does not include the first portion 463 and/or second portion 465. In these examples, a notch can be defined by portions of the sidewall 461, such as the first end portion 462, the second end portion 464, and a section or region of the base 460 adjacent to the aperture 468. Further details of an example of a support component 550 as described with respect to FIGS. 9A and 9B.

Figure 9A:
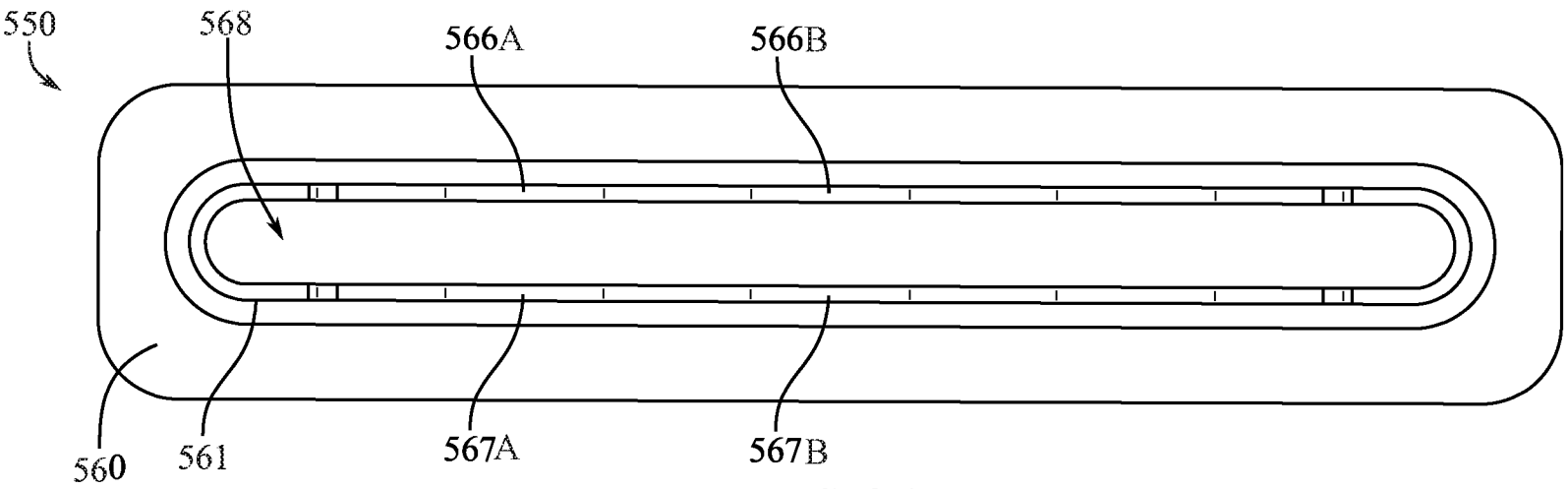
FIG. 9A shows a top view of an acoustic component.
Figure 9B:
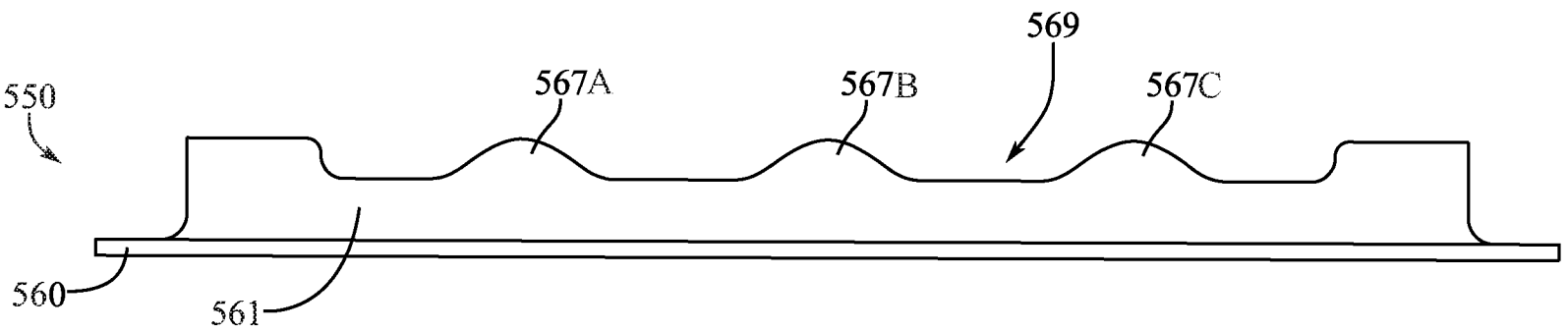
FIG. 9B shows a side view of the acoustic component of FIG. 9A.

FIGS. 9A and 9B illustrate top and side views, respectively, of a support component 550 that can be substantially similar to, and can include some or all of the features of the support components described herein, such as support components 150, 250, 350, 450. The support component 550 can include a base 560 defining an aperture 568, and can further include a sidewall 561 extending from the base 560 adjacent to the aperture 568. In some examples, the sidewall 461 can include one or more protruding members 566A, 566B, 567A, 567B that can extend from portions of the sidewall 561. As shown in FIG. 9B, in some examples the protruding portions 567A, 567B, 567C can have an approximately triangular shaped profile, and can define, along with other portions of the sidewall 561, multiple notches having a different shapes.

In some examples, the protruding members 566A, 556B, 567A, 567B having a triangular profile, for example, including rounded top portion as shown, can provide desired levels of physical support to an air permeable component disposed thereover, while also defining notches or gaps having a large open area and defining an open flux area 569 that is larger than the area of the aperture 568, as described herein. In some examples, in addition to the reduction in flow noise provided by the larger open flux area 569, the geometry of the protruding members 566A, 556B, 567A, 567B can affect or influence airflow through the aperture 568 and open flux area 569 in such a way as to further reduce flow noise or acoustic signal disruption. For example, the structure of the sidewall 561 can reduce turbulence, vortices, or other irregularities in the airflow passing through the open flux area 569. Further details of an example of a support component 650 are described below with reference to FIGS. 10A-10B.

Figure 10A:
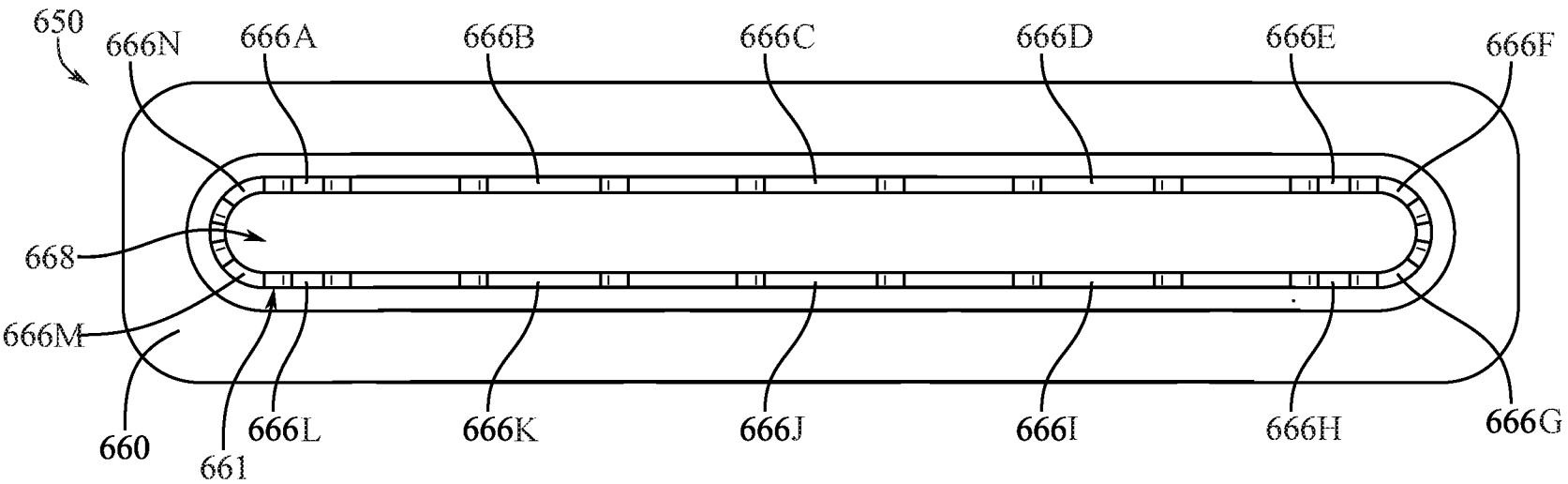
FIG. 10A shows a top view of an acoustic component.
Figure 10B:
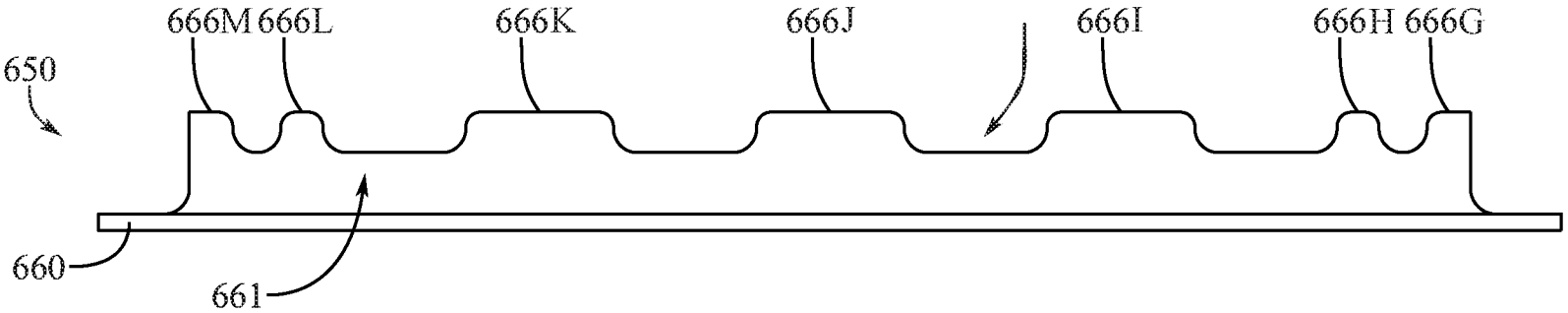
FIG. 10B shows a side view of the acoustic component of FIG. 10A.

FIGS. 10A and 10B illustrate top and side views, respectively, of a support component 650 that can be substantially similar to, and can include some or all of the features of the support components described herein, such as support components 150, 250, 350, 450, 550. The support component 650 can include a base 660 defining an aperture 668, and further includes a sidewall 661 extending from the base adjacent to the aperture 668.

Whereas some examples of support components described herein can include sidewalls that include one or more portions that do not include protruding members extending therefrom, the illustrated sidewall 661 can include a number of protruding members 666A, 666B, 666C, 666D, 666E, 666F, 666G, 666H, 666I, 666J, 666K, 666L, 666M, 666N that extend from the sidewall 661 around substantially the entire periphery of the aperture 668. In some examples, the dimensions of the protruding members 666A, 666B, 666C, 666D, 666E, 666F, 666G, 666H, 666I, 666J, 666K, 666L, 666M, 666N and the dimensions of the notches defined by the protruding members 666A, 666B, 666C, 666D, 666E, 666F, 666G, 666H, 666I, 666J, 666K, 666L, 666M, 666N can vary at different locations along the sidewall 661. In some examples, however, the protruding members 666A, 666B, 666C, 666D, 666E, 666F, 666G, 666H, 666I, 666J, 666K, 666L, 666M, 666N, and the notches defined by adjacent protruding members 666, can be substantially evenly or regularly positioned around the periphery of the aperture 668. In some examples, the protruding members 666A, 666B, 666C, 666D, 666E, 666F, 666G, 666H, 666I, 666J, 666K, 666L, 666M, 666N can be any desired combination of sizes and shapes so as to form or define any number of notches having any desired combination of sizes and shapes. For example, the protruding members 666A, 666B, 666C, 666D, 666E, 666F, 666G, 666H, 666I, 666J, 666K, 666L, 666M, 666N can be designed and arranged to define a pattern of notches that can further reduce flow noise associated with airflow passing through the open flux area 669.

Any number or variety of electronic device components can include some or all of the structure of the support components described herein. In some examples, a support component or a component including some or all of the features of a support component described herein can provide physical or structural support for any number of additional components, for example, components disposed at, spanning, or otherwise adjacent or near to any aperture or opening of an electronic device. In some examples, components including the features described herein can be formed by any number or combination of additive and/or subtractive manufacturing processes or steps, such as drawing, forming, piercing, and punching.

Any number or variety of electronic device components can include some or all of the structure of the support components described herein. In some examples, a support component or a component including some or all of the features of a support component described herein can provide physical or structural support for any number of additional components, for example, components disposed at, spanning, or otherwise adjacent or near to any aperture or opening of an electronic device. In some examples, components including the features described herein can be formed by any number or combination of additive and/or subtractive manufacturing processes or steps, such as drawing, forming, piercing, and punching. Various examples of support components and other acoustic components, as well as processes for forming the same, are described below with reference to FIGS. 11A-12.

Figures 11A, 11B, 11C, 11D:
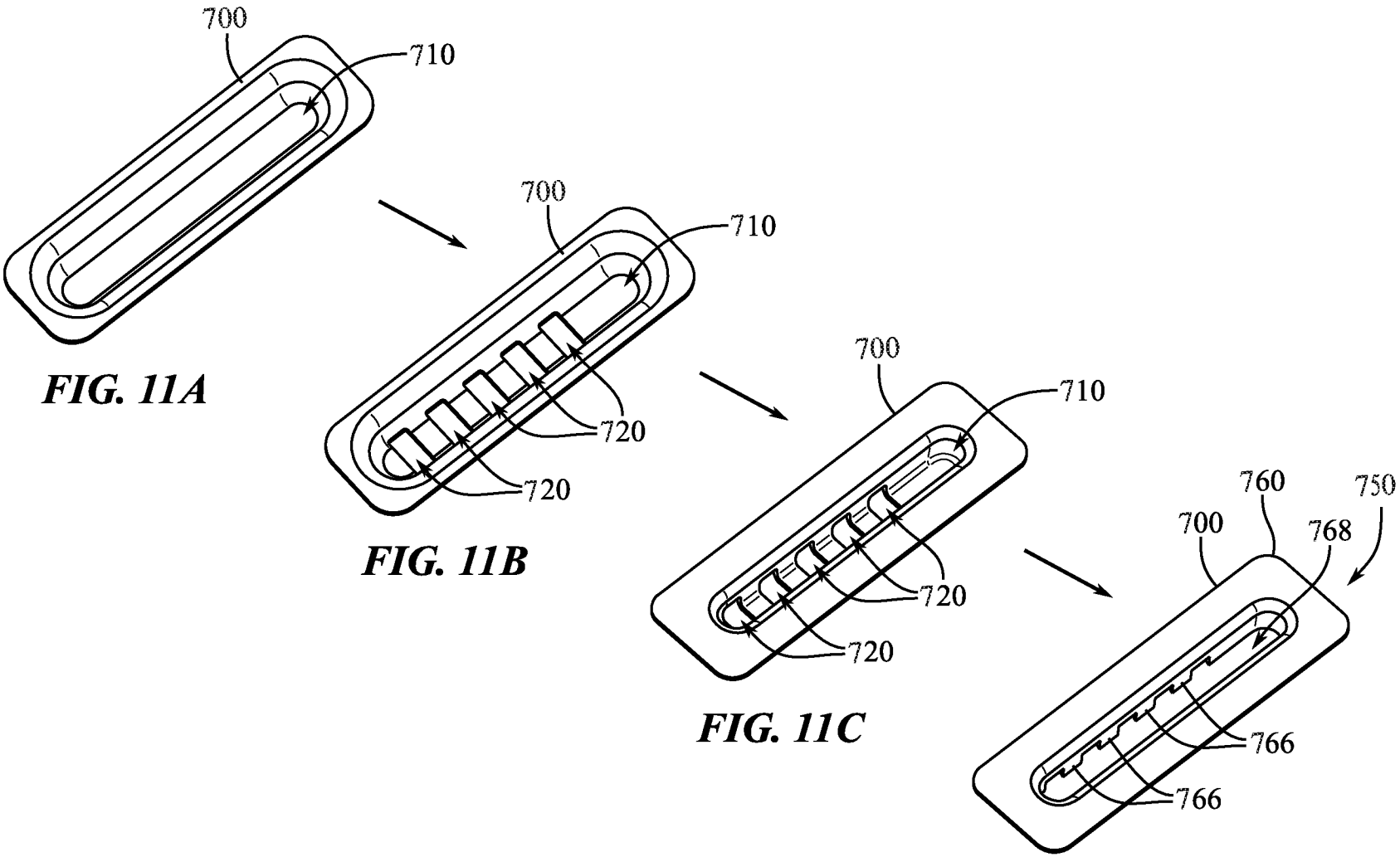
FIGS. 11A-11D show stages of a process for forming an acoustic component.

FIGS. 11A-11D show stages of a process for forming an acoustic component, such as a support component, as described herein. FIG. 11A shows a portion or a blank of material 700 that has been formed into a shape defining a recess 710. In some examples, the material 700 can be formed into a shape defining the recess 710 by any combination of additive or subtractive manufacturing processes. In some examples, the material 700 can be cast or molded into the shape defining the recess 710. In some examples, material 700 can be a substantially flat or planar piece of material, and can be formed or drawn into a shape defining the recess 710.

As shown in FIG. 11B, multiple apertures or openings 720 can be formed in the portion of the material 700 defining the recess 710. In some examples, the apertures 720 can be sized and positioned as desired. In some examples, the size and position of the apertures 720 can correspond to a desired size and position of protrusions 766 extending from the sidewall of the support component 750 formed by the processes described herein. The apertures 720 can be formed by any desired process or combination of processes, and in some examples, can be formed by piercing or punching with a tool, by machining, or by combinations thereof. In some examples, the apertures 720 can be formed by removing material, while in some examples, the apertures 720 can be formed by methods that do not result in the removal of material 700.

In FIG. 11C, the material 700 can be subjected to a forming process to extend the depth of the recess 710. In some examples, this forming process can include a drawing process. In some examples, the material 700 can be heated to a desired temperature, for example, to increase the malleability or ductility of the material 700 during the forming process. As shown, the portions of material 700 in the recess 710 defining the apertures 720 in FIG. 11B can now be at least partially oriented at an angle, such as a right angle, relative to a base portion of the material 700.

In FIG. 11D, the multiple apertures 720 are combined into a single aperture 768. In some examples, this can be accomplished by removing material, for example, material defining the recess 710. In some other examples, however, the single aperture 768 can be formed by any number processes that do not result in the removal of material 700. As can be seen, portions of material 700 in the recess 710 that defined the apertures 720 now form protrusions 766 that extend from a base portion 760 adjacent to the aperture 768. Accordingly, the support component 750 can now include a base portion 760 defining an aperture 768, and further including one or more protruding members 766 that can extend from the base portion 760 around the aperture 768 to form a sidewall that defines an open flux area, as described herein.

Figure 12:
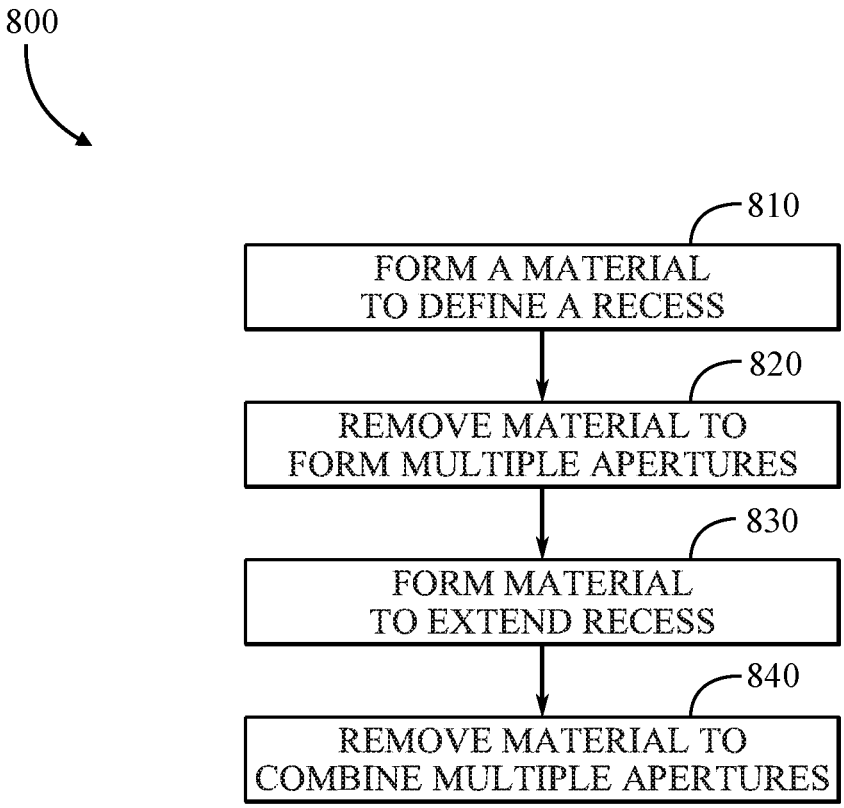
FIG. 12 shows a process flow diagram for a process of forming an acoustic component.

FIG. 12 shows a process flow diagram for a process 800 of forming an acoustic component. The acoustic component can be a support component for an air permeable component and can be substantially similar to, and can include some or all of the features of the support components 150, 250, 350, 450, 550, 650, 750 described herein. The process 800 can include forming a material to define a recess at block 810, removing material to form multiple apertures in the material at block 820, forming the material to further extend the recess at block 830, and removing material to combine the multiple apertures into a single aperture at block 840.

At block 810, a material is formed into a shape that defines a recess. In some examples, this forming process can include any additive or subtractive manufacturing process or combinations thereof. In some examples, the forming process can be substantially similar to the process described with respect to FIG. 11A and can include a stamping, casting, or drawing processes as described herein.

At block 820, material is removed from the shape defining the recess to form multiple apertures. In some examples, the material is removed from a portion of the shape that defines the recess so that the multiple apertures can be located in the recess. In some examples, the material can be removed by a punching or piercing process as described with respect to FIG. 11B. In some examples, however, the multiple apertures can be formed by a method or step that does not include the removal of material, for example, by piercing the material to form an aperture and expanding the aperture by deforming the material, rather than through the removal of material.

At block 830, the material formed into a shape defining a recess and multiple apertures can be subjected to additional forming to extend the depth of the recess. In some examples, the process of block 830 can be substantially similar to the processes or steps described above with respect to FIG. 11C. As shown in FIG. 11C, in some examples, block 830 can result in a structure of the material that includes one or more protrusions extending away from a base portion at an angle, such as a right angle.

At block 840, material is removed to form or combine the multiple apertures into a single aperture, for example, as described with respect to FIG. 11D. In some examples, the resultant structure can include a base portion that can define the single aperture and one or more protruding members extending at an angle from the base portion around the aperture as described herein. In some examples, the protruding members can be portions of the material that at least partially defined the multiple aperture formed in block 820. Further, in some examples, the multiple apertures can be combined into a single aperture by a method or a step that does not include the removal of material, for example, by expanding one or more of the apertures by deforming the material rather than through the removal of material.

Any of the features or aspects of the components discussed herein can be combined or included in any varied combination. For example, the design and shape of the support components described herein are not limited in any way, and can be formed by any number of processes, including those discussed herein. Further, the principles and structure described with respect to a support component can also be used in conjunction with other types of device or components and/or assemblies and are not limited to being applicable to acoustic components.

To the extent applicable to the present technology, gathering and use of data available from various sources can be used to improve the delivery to users of invitational content or any other content that can be of interest to them. The present disclosure contemplates that in some instances, this gathered data can include personal information data that uniquely identifies or can be used to contact or locate a specific person. Such personal information data can include demographic data, location-based data, telephone numbers, email addresses, TWITTER® ID's, home addresses, data or records relating to a user's health or level of fitness (e.g., vital signs measurements, medication information, exercise information), date of birth, or any other identifying or personal information.

The present disclosure recognizes that the use of such personal information data, in the present technology, can be used to the benefit of users. For example, the personal information data can be used to deliver targeted content that is of greater interest to the user. Accordingly, use of such personal information data enables users to calculated control of the delivered content. Further, other uses for personal information data that benefit the user are also contemplated by the present disclosure. For instance, health and fitness data may be used to provide insights into a user's general wellness or may be used as positive feedback to individuals using technology to pursue wellness goals.

The present disclosure contemplates that the entities responsible for the collection, analysis, disclosure, transfer, storage, or other use of such personal information data will comply with well-established privacy policies and/or privacy practices. In particular, such entities should implement and consistently use privacy policies and practices that are generally recognized as meeting or exceeding industry or governmental requirements for maintaining personal information data private and secure. Such policies should be easily accessible by users and should be updated as the collection and/or use of data changes. Personal information from users should be collected for legitimate and reasonable uses of the entity and not shared or sold outside of those legitimate uses. Further, such collection/sharing should occur after receiving the informed consent of the users. Additionally, such entities should consider taking any needed steps for safeguarding and securing access to such personal information data and ensuring that others with access to the personal information data adhere to their privacy policies and procedures. Further, such entities can subject themselves to evaluation by third parties to certify their adherence to widely accepted privacy policies and practices. In addition, policies and practices should be adapted for the particular types of personal information data being collected and/or accessed and adapted to applicable laws and standards, including jurisdiction-specific considerations. For instance, in the US, collection of or access to certain health data may be governed by federal and/or state laws, such as the Health Insurance Portability and Accountability Act (HIPAA); whereas health data in other countries may be subject to other regulations and policies and should be handled accordingly. Hence different privacy practices should be maintained for different personal data types in each country.

Despite the foregoing, the present disclosure also contemplates embodiments in which users selectively block the use of, or access to, personal information data. That is, the present disclosure contemplates that hardware and/or software elements can be provided to prevent or block access to such personal information data. For example, in the case of advertisement delivery services, the present technology can be configured to allow users to select to "opt in" or "opt out" of participation in the collection of personal information data during registration for services or anytime thereafter. In another example, users can select not to provide mood-associated data for targeted content delivery services. In yet another example, users can select to limit the length of time mood-associated data is maintained or entirely prohibit the development of a baseline mood profile. In addition to providing "opt in" and "opt out" options, the present disclosure contemplates providing notifications relating to the access or use of personal information. For instance, a user may be notified upon downloading an app that their personal information data will be accessed and then reminded again just before personal information data is accessed by the app.

Moreover, it is the intent of the present disclosure that personal information data should be managed and handled in a way to minimize risks of unintentional or unauthorized access or use. Risk can be minimized by limiting the collection of data and deleting data once it is no longer needed. In addition, and when applicable, including in certain health related applications, data de-identification can be used to protect a user's privacy. De-identification may be facilitated, when appropriate, by removing specific identifiers (e.g., date of birth, etc.), controlling the amount or specificity of data stored (e.g., collecting location data a city level rather than at an address level), controlling how data is stored (e.g., aggregating data across users), and/or other methods.

Therefore, although the present disclosure broadly covers use of personal information data to implement one or more various disclosed embodiments, the present disclosure also contemplates that the various embodiments can also be implemented without the need for accessing such personal information data. That is, the various embodiments of the present technology are not rendered inoperable due to the lack of all or a portion of such personal information data. For example, content can be selected and delivered to users by inferring preferences based on non-personal information data or a bare minimum amount of personal information, such as the content being requested by the device associated with a user, other non-personal information available to the content delivery services, or publicly available information.

As used herein, the terms exterior, outer, interior, inner, top, and bottom are used for reference purposes only. An exterior or outer portion of a component can form a portion of an exterior surface of the component but may not necessarily form the entire exterior of outer surface thereof. Similarly, the interior or inner portion of a component can form or define an interior or inner portion of the component but can also form or define a portion of an exterior or outer surface of the component. A top portion of a component can be located above a bottom portion in some orientations of the component, but can also be located in line with, below, or in other spatial relationships with the bottom portion depending on the orientation of the component.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. An electronic device, comprising:

a housing defining a first aperture and at least partially defining an internal volume;

an air permeable component disposed at the first aperture; and a support component engaging the air permeable component and defining a second aperture in communication with the first aperture;

the support component comprising a sidewall disposed in the first aperture and defining at least one notch.

2. The electronic device of claim 1, wherein the sidewall defines an open flux area that is at least 10% larger than an area of the first aperture and in communication with the second aperture.

3. The electronic device of claim 1, further comprising a speaker disposed in the internal volume.

4. The electronic device of claim 1, wherein the sidewall defines at least six notches.

5. The electronic device of claim 1, wherein the sidewall surrounds a periphery of the second aperture.

6. The electronic device of claim 1, wherein the air permeable component comprises an acoustic mesh.

7. The electronic device of claim 1, wherein the support component comprises steel.

8. The electronic device of claim 1, wherein at least a portion of the air permeable component is disposed between the support component and a portion of the housing defining the first aperture.

9. The electronic device of claim 1, wherein the support component comprises a base extending perpendicularly from the sidewall, and the base is adhered to an interior surface defined by the housing.

10. An acoustic cover assembly, comprising:

an air permeable component; and a support component engaged with the air permeable component, the support component comprising;

a base defining an aperture;

a sidewall extending from the base adjacent to the aperture, the sidewall comprising at least two protruding members;

the sidewall defining an open flux area at least 10% larger than an area of the aperture and in communication with the aperture.

11. The acoustic cover assembly of claim 10, wherein the sidewall comprises:

a first portion extending from the base adjacent to a first peripheral portion of the aperture in a direction;

a first set of protruding members extending from the first portion in the direction;

a second portion extending from the base adjacent to a second peripheral portion of the aperture, the second peripheral portion opposite the first peripheral portion; and a second set of protruding members extending from the second portion in the direction.

12. The acoustic cover assembly of claim 11, wherein the first set of protruding members comprises two protruding members, and the second set of protruding members comprises two protruding members.

13. The acoustic cover assembly of claim 10, wherein the open flux area is at least 15% larger than the area of the aperture.

14. The acoustic cover assembly of claim 10, wherein the protruding members have a rectangular shape.

15. The acoustic cover assembly of claim 10, wherein the protruding members have a triangular or rounded shape.

16. The acoustic cover assembly of claim 10, wherein the protruding members define a top surface of the support component that is nonparallel relative to the base.

17. A method of forming a support component for an air permeable component, comprising:

drawing a body into a shape defining a recess;

forming multiple first apertures in the body defining the recess;

further drawing the body to increase a depth of the recess; and removing a portion of the body defining the recess to define a second aperture and at least one protrusion adjacent to the second aperture.

18. The method of claim 17, wherein the at least one protrusion comprises a castellated sidewall defining an open flux area at least 10% larger than the second aperture when supporting the air permeable component.

19. The method of claim 17, wherein the support component comprises a base and a sidewall extending from the base, at least one protrusion extending from the sidewall and having a top surface that is nonparallel relative to the base.

20. The method of claim 17, wherein forming multiple first apertures comprises forming three first apertures in a portion of the body defining the recess.

* * * * *